US012722751B2

(12) United States Patent
Tegeder et al.

(10) Patent No.: US 12,722,751 B2
(45) Date of Patent: Sep. 1, 2026

(54) WATERSPORTS DEVICE FOR MANAGED ENGAGEMENT WITH THE WATER

(71) Applicant: Lakesurf, LLC, Murrieta, CA (US)

(72) Inventors: Troy Tegeder, Winchester, CA (US); Stephen Hale, Winchester, CA (US)

(73) Assignee: Lakesurf, LLC, Murrieta, CA (US)

( * ) Notice: Subject to any disclaimer, the term of this patent is extended or adjusted under 35 U.S.C. 154(b) by 434 days.

(21) Appl. No.: 18/481,461

(22) Filed: Oct. 5, 2023

(65) Prior Publication Data

US 2025/0115336 A1 Apr. 10, 2025

(51) Int. Cl.
*B63B 34/54* (2020.01)
*B63B 32/53* (2020.01)
*B63B 32/70* (2020.01)

(52) U.S. Cl.
CPC ..... *B63B 34/54* (2020.02); *B63B 32/53* (2020.02); *B63B 32/70* (2020.02)

(58) Field of Classification Search
CPC ..... B63B 34/54; B63B 32/53; B63B 32/70
See application file for complete search history.

(56) References Cited

U.S. PATENT DOCUMENTS 3,380,090 A * 4/1968 Kenmuir ..... B63B 34/54 280/845
4,649,847 A * 3/1987 Tinkler ..... B63B 39/061 441/74
4,725,252 A * 2/1988 McNeil ..... B63C 9/20 441/89
5,354,222 A * 10/1994 Elias ..... B63B 21/56 441/80
6,062,930 A * 5/2000 Smith ..... A47C 15/006 441/125
2019/0002062 A1* 1/2019 Villarreal ..... B63B 32/60

FOREIGN PATENT DOCUMENTS

AU 2019228337 A1 * 9/2020 ..... B63B 21/56

* cited by examiner

*Primary Examiner* — Stephen P Avila
(74) *Attorney, Agent, or Firm* — Kirton McConkie; Brian Tucker

(57) ABSTRACT

Watersports devices can be configured to provide managed engagement with the water. A watersports device may include a deck and a cape that extends rearwardly from the deck. The cape forms a barrier between the rider and the water while the rider is supported on the deck. Furthermore, the cape may move and flow with the water to approximate the sensation of dragging in the water. Accordingly, such watersports devices can encourage individuals to participate in watersports even when they may be fearful or may lack the skills necessary for mastering traditional watersports devices.

20 Claims, 7 Drawing Sheets

WATERSPORTS DEVICE FOR MANAGED ENGAGEMENT WITH THE WATER

CROSS-REFERENCE TO RELATED APPLICATIONS

N/A

BACKGROUND

Many children and even adults are fearful of attempting to do watersports that involve being towed by a boat. Many individuals also lack the balance, coordination, strength, or skill to control or even ride on traditional watersports devices such as water skis, wakeboards, wakesurf boards, kneeboards, etc. To ride such watersports devices, many different abilities need to be performed in parallel including balance, water awareness, hand coordination and arm strength to hold onto the handle, leg strength, core strength, edge control, etc. Although there are inflatable towables that do not require balance or skill to ride, these towables are not steerable or controllable by the rider and therefore do not allow the rider to learn to control a watersports device. Many traditional watersports devices are also very large, making their mastery difficult for small children, and making storage on a boat difficult.

BRIEF SUMMARY

The present disclosure relates to watersports devices. In particular, watersports devices can be configured to provide managed engagement with the water. A watersports device may include a deck and a cape that extends rearwardly from the deck. The cape forms a barrier between the rider and the water while the rider is supported on the deck. Furthermore, the cape may move and flow with the water to approximate the sensation of dragging in the water. Accordingly, watersports devices configured in accordance with embodiments of the present disclosure can encourage individuals to participate in watersports even when they may be fearful or may lack the skills necessary for mastering traditional watersports devices.

In some embodiments, a watersports device may include a deck and a cape that extends rearwardly from the deck.

In some embodiments, the cape may be attached to a rear of the deck.

In some embodiments, the deck may be rigid, and the cape may be flexible.

In some embodiments, the watersports device may be buoyant.

In some embodiments, a front portion of the deck may be curved upwardly.

In some embodiments, the deck may include one or more handles.

In some embodiments, the one or more handles may be opposing handles.

In some embodiments, the deck may include a towing feature.

In some embodiments, the deck may include a pad.

In some embodiments, the cape may be coupled to the deck via a cape holder.

In some embodiments, the deck may form a cape connection area at which the cape may be coupled to the deck.

In some embodiments, the cape connection area may be formed on either or both a top surface or a bottom surface of the deck.

In some embodiments, a width of a rear of the cape may be greater than a width of the rear of the deck.

In some embodiments, the cape may be removably coupled to the deck.

In some embodiments, a watersports device may include a buoyant deck having a top surface for supporting an upper body of a rider and a flexible cape that extends rearwardly from the buoyant deck to form a barrier between a lower body of the rider and water as the buoyant deck travels through the water.

In some embodiments, the flexible cape may be coupled to a rear of the buoyant deck.

In some embodiments, the buoyant deck may include handles that the rider may grasp while the rider's elbows are supported on the top surface.

In some embodiments, the flexible cape may form a sheet that moves with the water.

In some embodiments, a watersports device may include a deck having a top surface for supporting a rider above water and a cape that extends rearwardly from the deck to form a barrier between the rider's legs and the water.

In some embodiments, the cape may be flexible such that the cape moves with the water as the deck travels through the water.

This summary is provided to introduce a selection of concepts in a simplified form that are further described below in the Detailed Description. This summary is not intended to identify key features or essential features of the claimed subject matter.

BRIEF DESCRIPTION OF THE DRAWINGS

Understanding that these drawings depict only typical embodiments of the present disclosure and are not therefore to be considered limiting of its scope, the present disclosure will be described and explained with additional specificity and detail through the use of the accompanying drawings in which.

DETAILED DESCRIPTION

Figure 1:
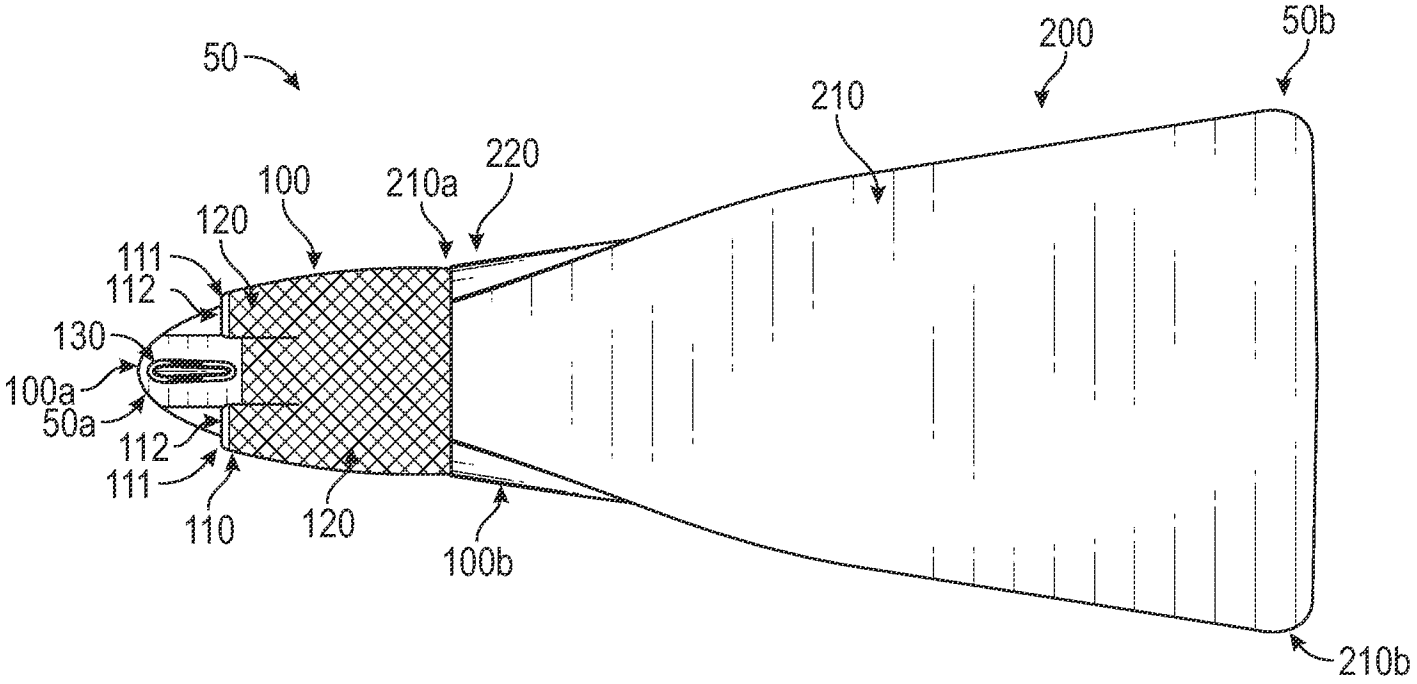
FIG. 1 is a top view of a watersports device that is configured in accordance with one or more embodiments of the present disclosure.

A watersports device configured in accordance with one or more embodiments of the present disclosure can include a deck that is configured to support a rider and a cape that extends rearwardly from the deck. The deck can be sufficiently buoyant so that it may float along the surface of the water when it is towed, propelled by a wake or wave, or otherwise advanced. The cape can be flexible and can trail rearwardly behind the deck where it can flow along the surface of the water. The rider can support himself on top of the deck in a prone position so that at least a portion of his lower body extends along the cape. In this way, the cape can act as a flexible barrier between the rider's lower body and the water as the deck travels through the water.

In some embodiments, the deck may have a sufficient length to allow the rider's elbows to rest on the deck. In some embodiments, the deck may be formed of a rigid material.

In some embodiments, the deck may include one or more handles that the rider may grasp. In some embodiments, opposing handles may extend upwardly from the top surface of the deck. In some embodiments, a single handle may extend upwardly from a central portion of the top surface of the deck. In some embodiments, a single handle may extend upwardly from the top surface of the deck and span a substantial width of the deck. In some embodiments, the deck may not include handles, but the sides of the deck may be configured to be grasped.

In some embodiments, a front portion of the deck may curve upwardly such that the front edge of the deck is oriented upwardly away from the water. In some embodiments, the upwardly curved front portion of the deck may be positioned frontward of any handles the deck may include.

In some embodiments, a pad may be positioned on the top surface of the deck. In some embodiments, the pad may extend at least partially onto any handles the deck may include.

In some embodiments, one or more fins may be formed along the bottom surface of the deck. In some embodiments, opposing fins may be formed along the bottom surface of the deck.

In some embodiments, the deck may include a towing feature by which a rope may be attached to the deck. In some embodiments, the towing feature may be positioned between opposing handles formed on the deck. In some embodiments, the towing feature may include a rope attachment point that projects frontwardly from the top surface of the deck and a rope hole in the deck that is positioned rearward of the rope attachment point.

In some embodiments, the cape may have a sufficient length to ensure that the rider's legs do not extend beyond the rear edge of the cape. In some embodiments, the cape may have a shorter length such that the rider's legs extend partially beyond the rear edge of the cape.

In some embodiments, the cape prevents the rider from being subjected to the drag force of water. In some embodiments, the cape imparts the sensation of flowing water to the rider's lower body.

In some embodiments, the cape prevents water from splashing up around the rear edge of the deck. In some embodiments, the cape can be permanently coupled to the rear edge of the deck. Any suitable technique and/or mechanism can be used to couple the cape to the deck. In some embodiments, the cape can be removably couped to the rear edge of the deck. In some embodiments, the sides of the cape may be folded upwardly at a front of the cape.

FIG. 1 provides an example of a watersports device 50 that is configured in accordance with one or more embodiments of the present disclosure. Watersports device 50 generally includes a deck assembly 100 at a front 50*a* and a cape assembly 200 at a rear 50*b*. Deck assembly 100 includes a deck 110 having a top surface 110*a* and a bottom surface 110*b* that extend between a front 100*a* and rear 100*b* of deck assembly 100.

Deck 110 includes opposing handles 111 that extend upwardly from top surface 110*a* and recesses 112 that are positioned frontward of handles 111. Deck 110 also includes a towing feature 130 by which a rope may be attached to deck 110. Deck assembly 100 may also include a pad 120 that is formed on, adhered to, or otherwise positioned on top surface 110*a* of deck 110. Pad 120 may substantially cover the portion of top surface 110*a* that is positioned rearward of handles 111. In some embodiments, pad 120 may also cover at least a portion of the rear side of handles 111.

Cape assembly 200 may include a cape 210 and a cape holder 220. Cape 210 can be formed of a flexible, thin material. A front 210*a* of cape 210 may be coupled to deck 110 via cape holder 220. A rear 210*b* of cape 210 may be free to drag behind deck 110 as deck 110 travels in the water. A width of cape 210 increases towards rear 210*b*. However, in some embodiments, cape 210 may have a constant width or may have a width that narrows towards rear 210*b*. Cape 210 could also have any other suitable shape, size and/or configuration.

Because cape 210 is flexible, watersports device 50 can be carried and/or stored in a relatively smaller area. For example, cape 210 could be folded up on top of deck 110 or wrapped around deck 110 so that watersports device 50 could be placed on or under a seat of a boat or stored in a boat's hull.

Figure 2:
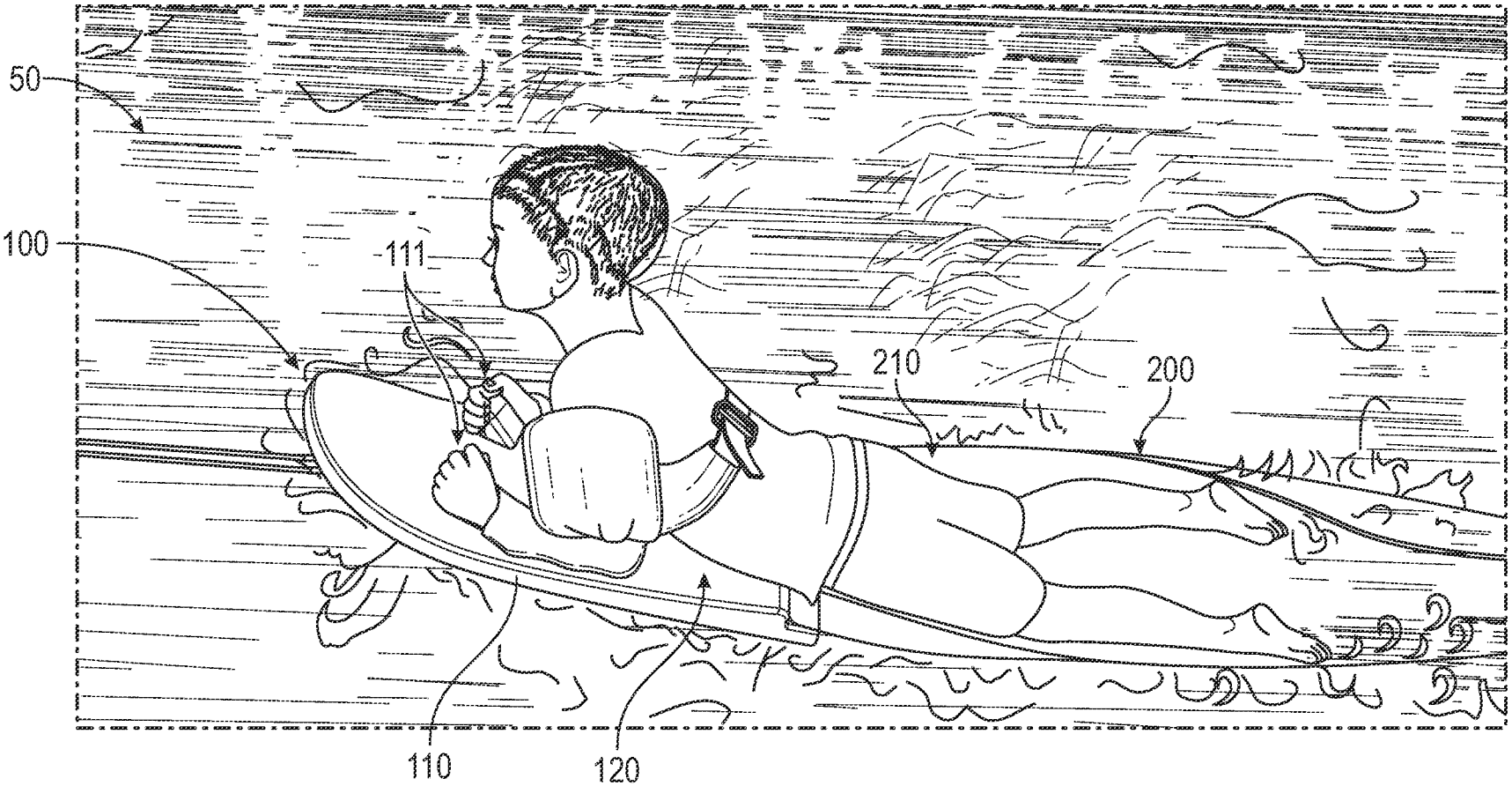
FIG. 2 provides an example of how a watersports device that is configured in accordance with one or more embodiments of the present disclosure can be used.

FIG. 2 provides another example of a watersports device 50 that is configured in accordance with one or more embodiments of the present disclosure. In FIG. 2, a rider is shown riding on top of watersports device 50 as it is towed in the water. Notably, the rider's elbows and stomach are supported on top of deck while his lower body rests on top of cape 210 as cape 210 is dragged behind deck 110. Accordingly, cape 210 acts as a barrier between the rider's lower body and the water to minimize the drag force on the rider. At the same time, the thin, flexible nature of cape 210 can cause the rider to feel the flowing sensation of the water. This can assist the rider to overcome fear of the water and to increase in confidence and skill.

Figure 3A:
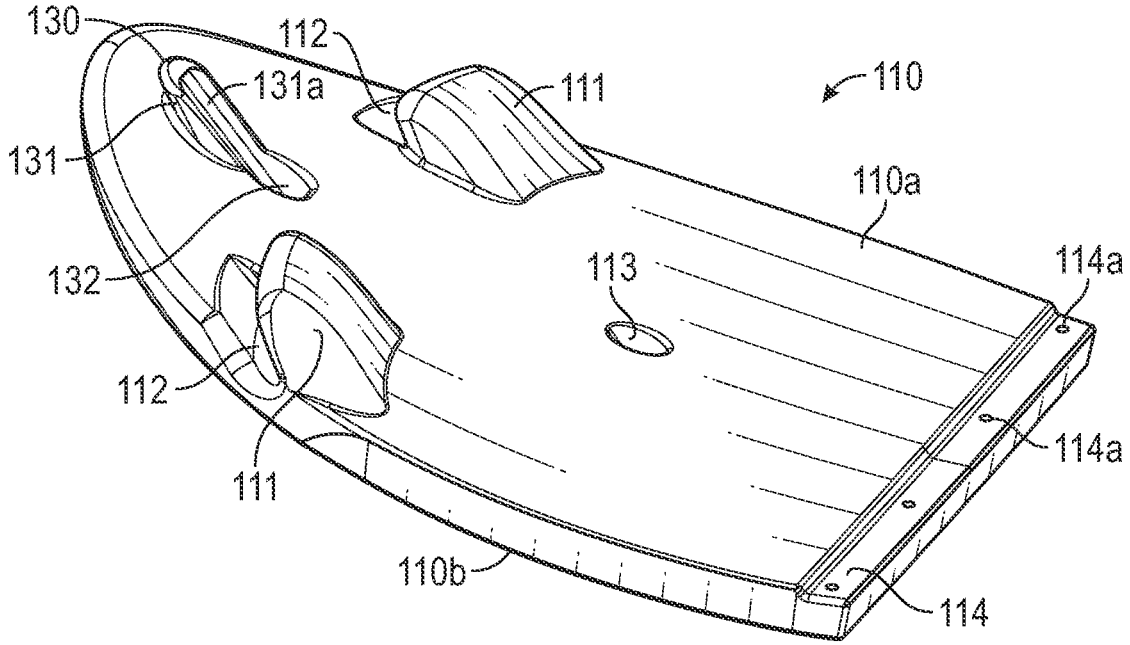
FIG. 3A is a top perspective view of an example deck that may be used on a watersports device that is configured in accordance with one or more embodiments of the present disclosure.
Figure 3B:
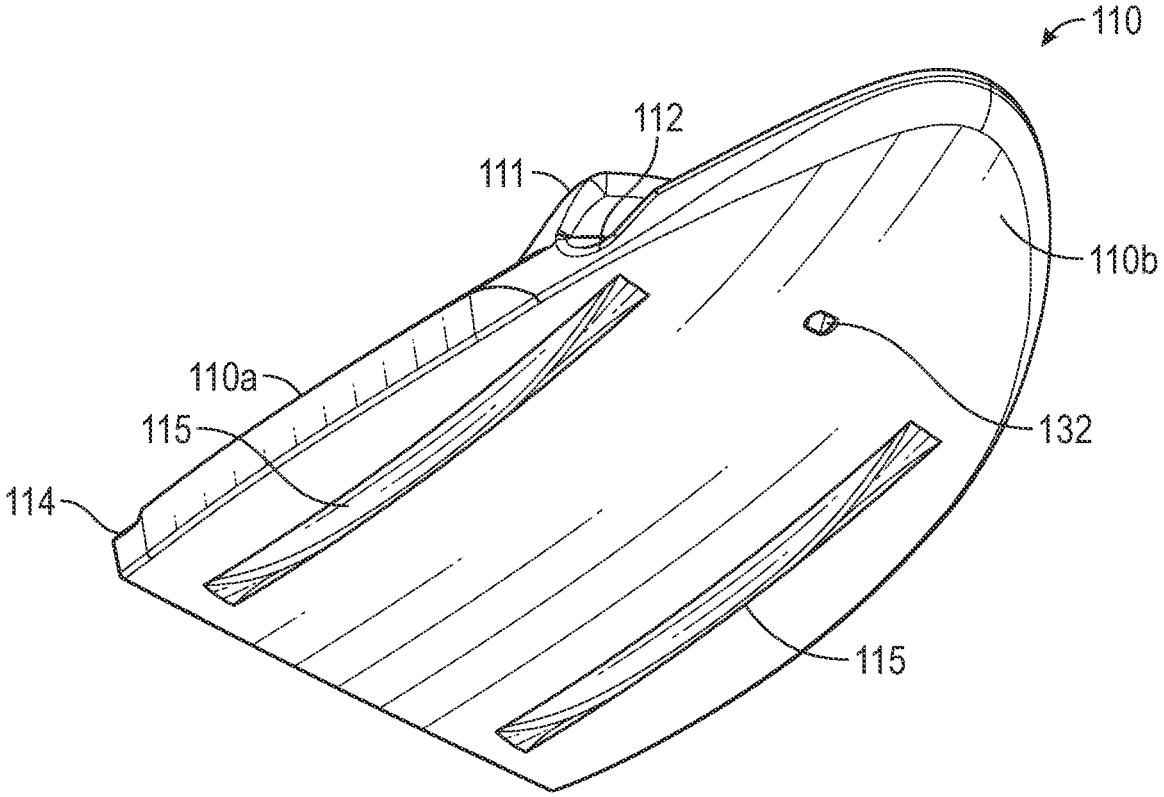
FIG. 3B is a bottom perspective view of the example deck of FIG. 3A.
Figure 3C:
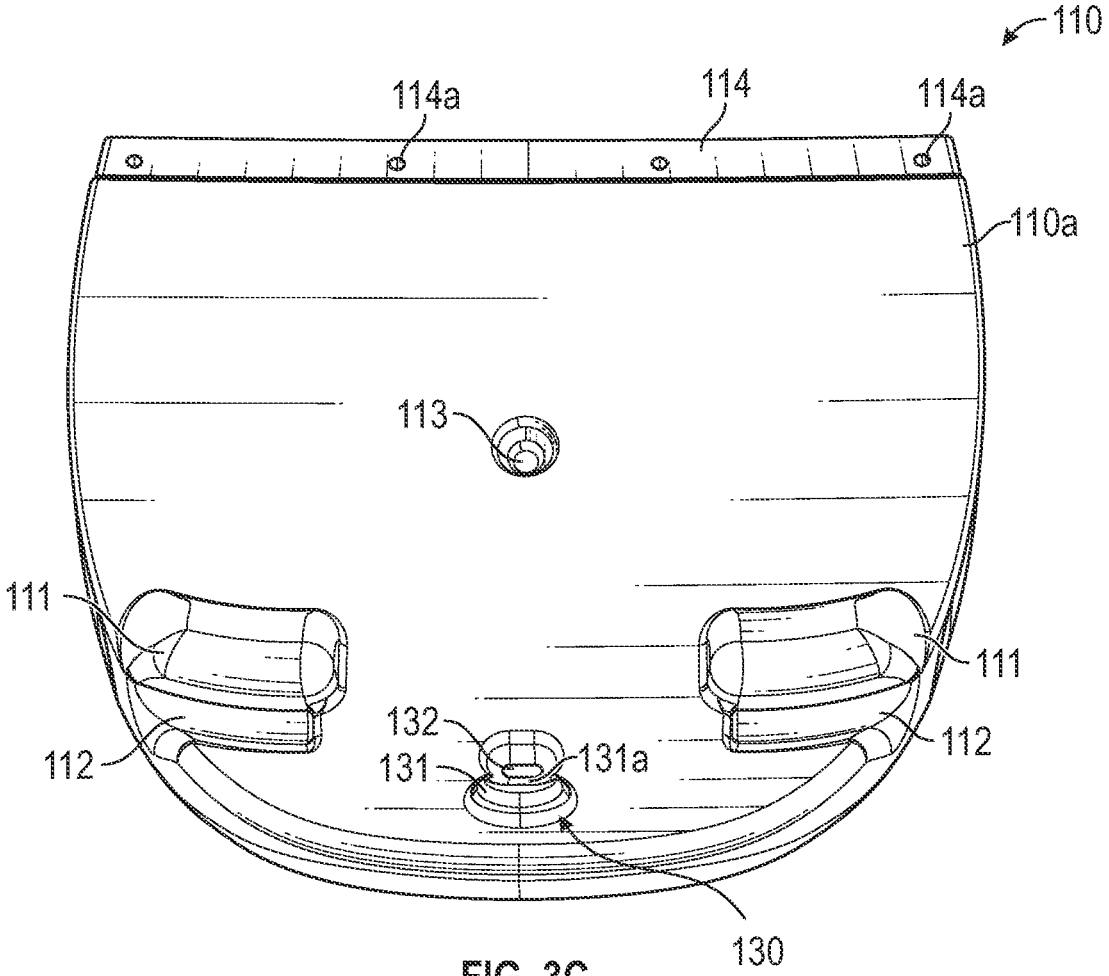
FIG. 3C is a top view of the example deck of FIG. 3A.
Figure 3D:
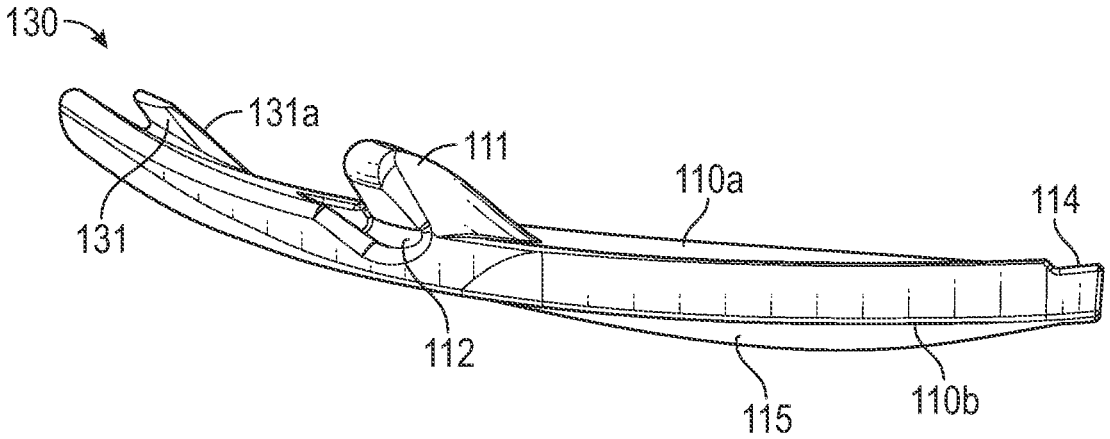
FIG. 3D is a side view of the example deck of FIG. 3A.
Figure 4:
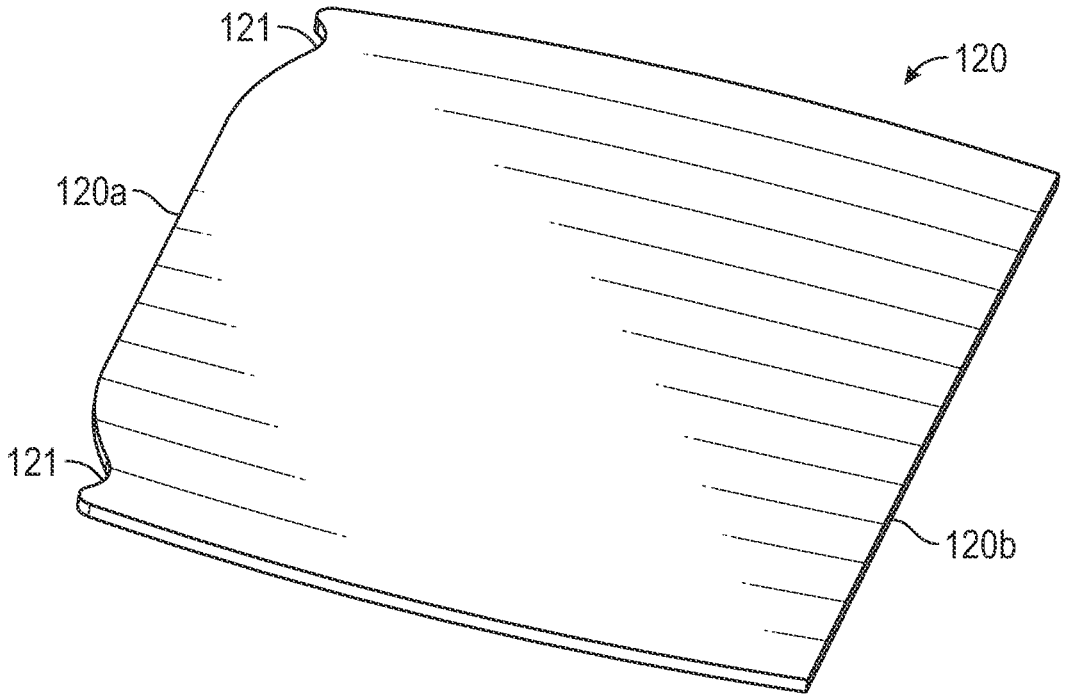
FIG. 4 is a top perspective view of an example pad that may be used on a deck of a watersports device that is configured in accordance with one or more embodiments of the present disclosure.
Figure 5:
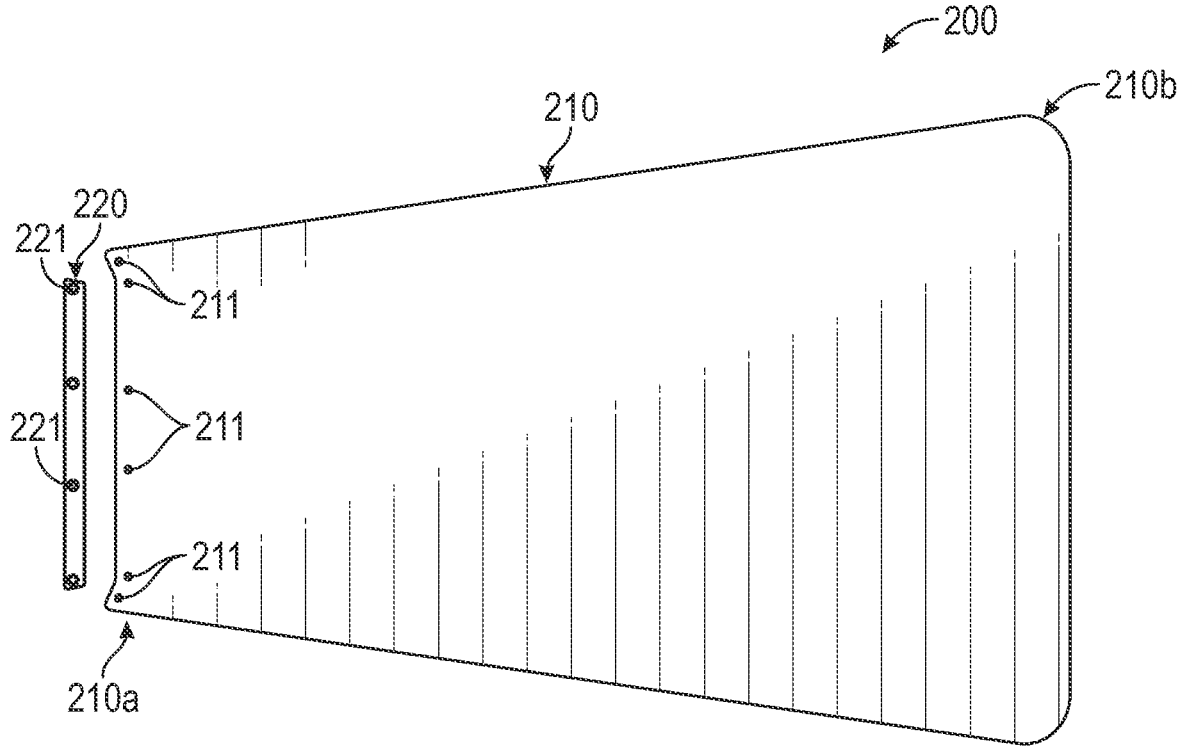
FIG. 5 is a top view of an example cape assembly that may be used on a watersports device that is configured in accordance with one or more embodiments of the present disclosure.
Figure 5A:
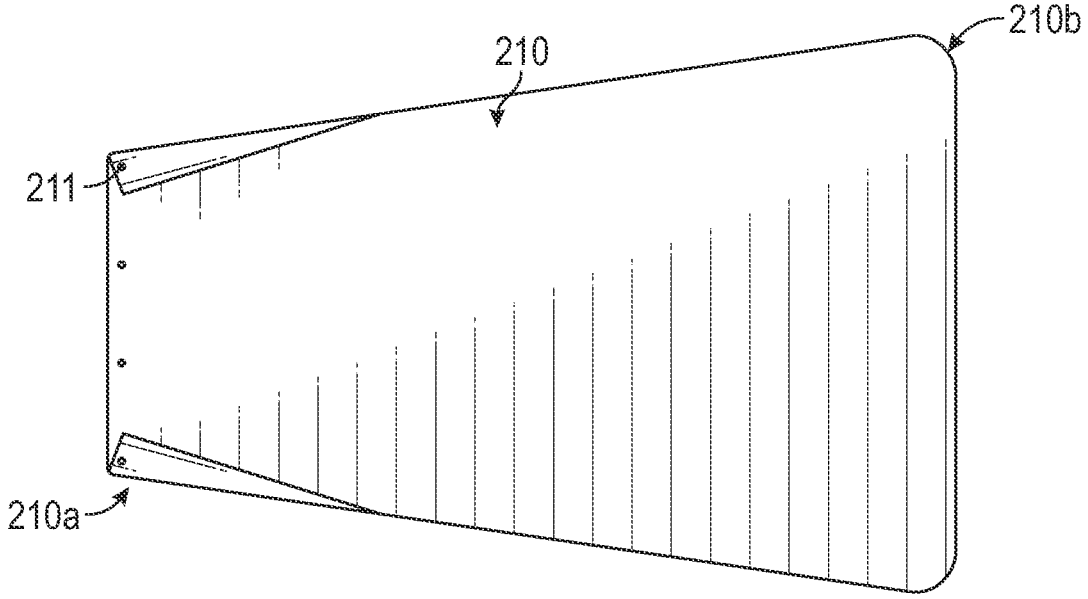
FIGS. 5A-5C illustrate how the example cape assembly of FIG. 5 may be assembled in one or more embodiments of the present disclosure.
Figure 5B:
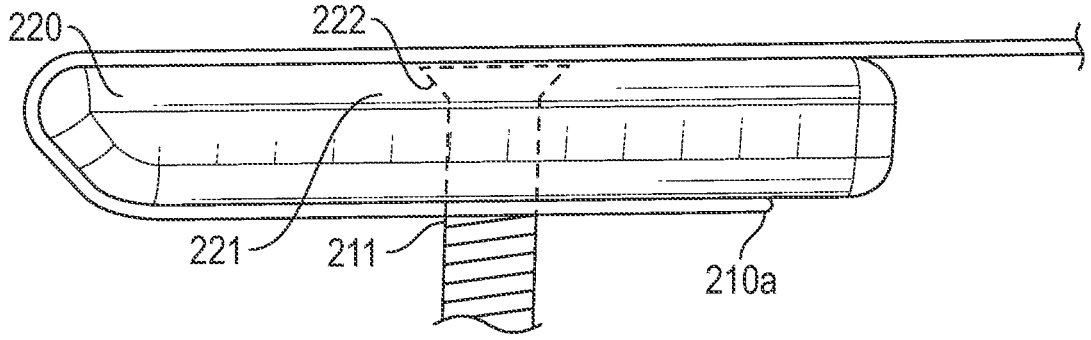
Figure 5C:
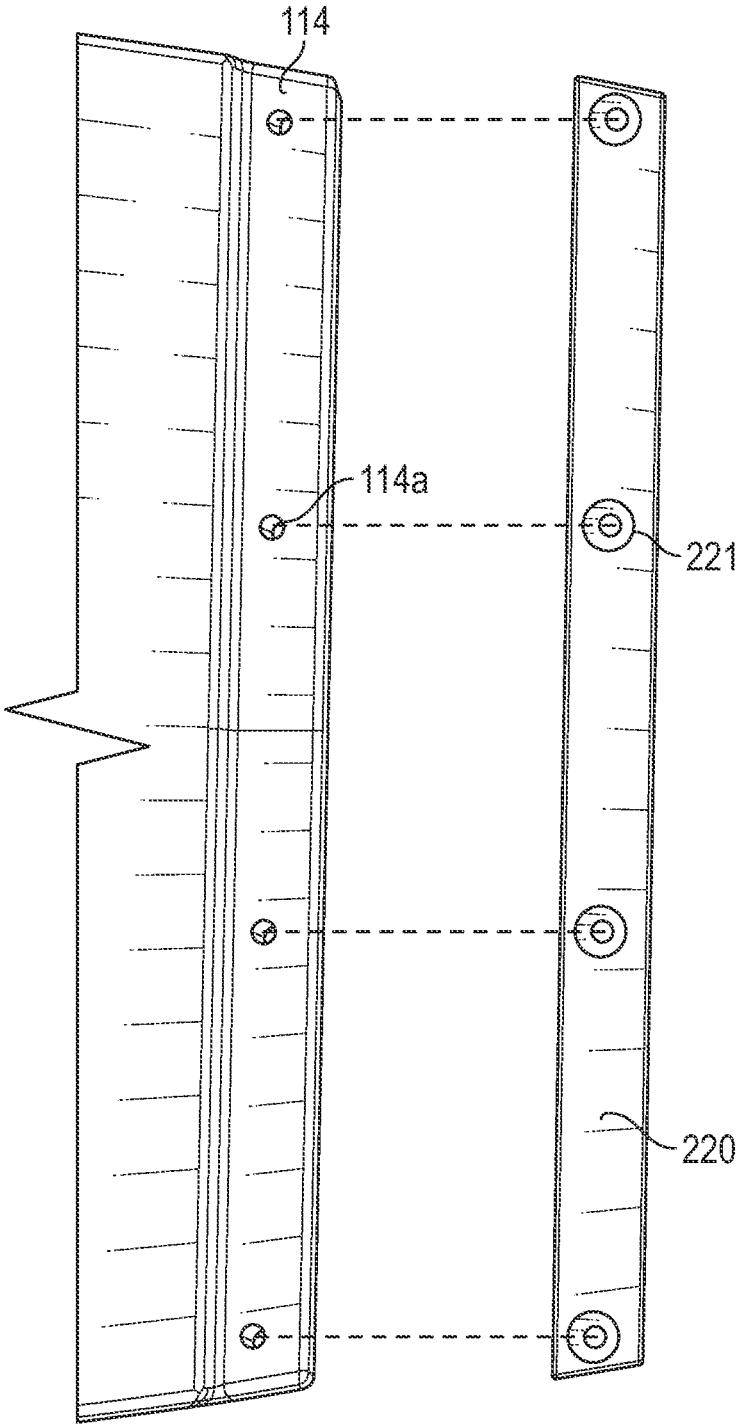

FIGS. 3A-5C provide additional examples of how a watersports device 50 could be configured in accordance with one or more embodiments of the present disclosure. FIGS. 3A-3D show a deck 110, FIG. 4 shows a pad 120 that may be used on deck 110, FIG. 5 shows a cape assembly 200 that may be coupled to deck 110, and FIGS. 5A-5C provide an example of how cape assembly 200 may be coupled to deck 110.

Turning to FIGS. 3A-3D, deck 110 is generally similar to deck 110 as shown in FIG. 1. For example, deck 110 includes opposing handles 111 that extend upwardly from top surface 110*a*. Each handle 111 may be positioned at the respective side of deck 110 and may be angled frontwardly. Recess 112 may be positioned frontward of each handle 111 and may extend inwardly relative to top surface 110*a*. Recess 112 may extend outwardly through the sidewall of deck 110 which may facilitate draining water from recess 112.

One or more reinforcing features 113 may be formed in top surface 110*a* and may cause deck 110 to have greater rigidity. Opposing fins 115 may be formed along bottom surface 110*b*. In the depicted embodiments, each fin 115 extends between handle 111 and the rear of deck 110. Integrated fins can aid in steering the device and changing direction while traversing through the water if the rider decides to do so, providing a means for the rider to develop some confidence and skill. As best shown in FIG. 3D, a front of deck 110 is curved upwardly such that the front of deck 110 may be positioned substantially above the rear of deck 110 during use. This may minimize the likelihood of the front of deck 110 dipping under the water.

A cape connection area 114 may be formed along the rear of deck 110. For example, in the depicted embodiments, cape connection area 114 is in the form of a recessed section that spans the width of deck 110. A number of holes 114*a* may be formed in cape connection area 114 and may be threaded to receive screws. However, a cape connection area on deck 110 could take any other suitable form and/or employ any other suitable mechanism for attaching cape 210 to deck 110. As some examples, a cape connection area could be configured for gluing or welding cape 210 to deck 110, could be configured with hook and loop or snaps, could be configured with a slot into or through which cape 210 inserts, etc. A cape connection area could be formed only on top surface 110*a*, only on bottom surface 110*b*, on both top surface 110*a* and bottom surface 110*b*, on sides of deck 110, fully around deck 110, through deck 110, or in any other suitable manner.

Towing feature 130 includes rope attachment point 131 and rope hole 132. In the depicted embodiment, rope attachment point 131 is in the form of a projection that extends frontwardly and upwardly from top surface 110*a*. Rope attachment point 131 may be centered between handles 111 to provide balance during towing and/or to facilitate pivoting of deck 110 around rope attachment point 131. In some embodiments, a rider may attempt to steer deck 110 by pulling on one of handles 111 and/or by leaning to one side of deck 110.

Rope attachment point 131 may include a rear face 131*a* that is flattened or channeled to receive a rope. Rope hole 132 may extend fully through deck 110 and may be positioned directly rearward of rope attachment point 131. Rope hole 132 may extend in a frontward orientation. A looped end of a rope may be inserted through rope hole 132 from bottom surface 110*b* and then wrapped around rope attachment point 131. A frontward force on the rope will therefore pull the looped end rearwardly against rope attachment point 131. The frontward and upward orientation of rope attachment point 131 can prohibit the rope from slipping off.

Turning to FIG. 4, pad 120 may include a front end 120*a* and a rear end 120*b*. Front end 120*a* may include one or more features 121 that correspond to handles 111. In some embodiments, features 121 may be configured to cause pad 120 to cover at least a portion of handles 111. In other embodiments, features 121 may be configured to cause pad 120 to terminate at the base of handles 111. Rear end 120*b* may have a shape and size that corresponds with the rear of deck 110 such that pad 120 can extend rearwardly up to cape 210.

Turning to FIG. 5, cape assembly 200 may include cape 210 and a cape holder 220. Cape holder 220 may correspond with cape connection area 114 and may be configured to couple front 210*a* of cape 210 to the rear of deck 110. In the depicted embodiment, cape holder 220 includes four holes 221 that align with holes 114*a* of cape connection area 114 as represented in FIG. 5C. However, any other suitable number of holes could be used. Front 210*a* of cape 210 also includes holes 211 that align with holes 221 and 114*a*. In the depicted embodiments, the width of cape 210 at front 210*a* is greater than the width of the rear of deck 110 (and therefore greater than the width of cape connection area 114 and cape holder 220). In such embodiments and as is represented in FIG. 5A, the sides of cape 210 at front 210*a* can be folded inwardly to cause the outermost holes 211 to align with the adjacent holes 211. Then, front 210*a* of cape 210 can be wrapped around cape holder 220 as shown in FIG. 5B. Screws 222 can be positioned under cape 210 and inserted into holes 221 as is also shown in FIG. 5B. Accordingly, with cape 210 wrapped around cape holder 220 and with screws 222 tightened into holes 114*a*, cape 210 will be sandwiched between cape holder 220 and cape connection area 114. The folding of the sides of cape 210 can reinforce cape 210 at this connection point and may also create a lip for diverting water away from the rider.

Any of the above-described features can be used on any embodiment of a watersports device that is configured in accordance with the present disclosure. In particular, no feature or combination of features should be limited to any of the embodiments depicted in the figures.

What is claimed:

1. A watersports device comprising:

a buoyant deck having a top surface configured to support an upper body of a prone rider as the deck travels through water; and a flexible cape comprising a thin sheet that extends rearwardly from the deck and has a front portion coupled to the deck and a rear portion that is free to drag behind the deck along a surface of the water as the deck travels through the water, the flexible cape being configured to receive at least a portion of a lower body of the prone rider thereon and to move with the water to impart a sensation of flowing water to the lower body.

2. The watersports device of claim 1, wherein the cape is attached to a rear of the deck.

3. The watersports device of claim 1, wherein the deck is rigid.

4. The watersports device of claim 1, wherein a front portion of the deck is curved upwardly.

5. The watersports device of claim 1, wherein the deck includes one or more handles.

6. The watersports device of claim 5, wherein the one or more handles comprise opposing handles.

7. The watersports device of claim 1, wherein the deck includes a towing feature.

8. The watersports device of claim 1, wherein the deck includes a pad.

9. The watersports device of claim 1, wherein the cape is coupled to the deck via a cape holder.

10. The watersports device of claim 1, wherein the deck forms a cape connection area at which the cape is coupled to the deck.

11. The watersports device of claim 10, wherein the cape connection area is formed on one or both of a top surface and a bottom surface of the deck.

12. The watersports device of claim 1, wherein a width of a rear of the cape is greater than a width of the rear of the deck.

13. The watersports device of claim 1, wherein the cape is removably coupled to the deck.

14. A watersports device comprising:

a buoyant deck having a top surface for supporting an upper body of a prone rider and a cape connection area formed along a rear of the buoyant deck; and a flexible cape comprising a thin sheet that extends rearwardly from the buoyant deck to form a barrier between a lower body of the rider and water as the buoyant deck travels through the water, wherein a front portion of the flexible cape is coupled to the cape connection area via a cape holder, wherein the front portion of the flexible cape is wrapped around the cape holder and sandwiched between the cape holder and the cape connection area, and wherein a rear portion of the flexible cape is free to trail along a surface of the water as the buoyant deck travels through the water.

15. The watersports device of claim 14, wherein the cape connection area comprises a recessed section that spans a width of the rear of the buoyant deck.

16. The watersports device of claim 14, wherein the buoyant deck includes handles that the rider grasps while the rider's elbows are supported on the top surface, and wherein the handles comprise opposing handles positioned on opposite sides of a towing feature of the buoyant deck, the towing feature being centered between the opposing handles.

17. The watersports device of claim 14, wherein the rear portion of the flexible cape is free to drag behind the buoyant deck while moving with the water to impart a sensation of flowing water to the lower body of the rider and to minimize drag force on the rider.

18. A watersports device comprising:

a deck having a top surface for supporting a rider above water in a prone position; and a cape that extends rearwardly from the deck to form a barrier between the rider's legs and the water, wherein the deck includes opposing handles extending upwardly from the top surface, wherein the deck includes a towing feature positioned between the opposing handles, wherein the towing feature includes a rope attachment point that projects frontwardly and upwardly from the top surface and a rope hole in the deck that is positioned rearward of the rope attachment point, and wherein the rope attachment point is configured to receive a looped end of a rope after the looped end of the rope is inserted through the rope hole from a bottom surface of the deck.

19. The watersports device of claim 18, wherein the cape is flexible and comprises a thin sheet having a rear portion that is free to drag behind the deck such that the cape moves with the water as the deck travels through the water to impart a sensation of flowing water to the rider's legs.

20. The watersports device of claim 14, wherein side portions of the front portion of the flexible cape are folded inwardly before the front portion of the flexible cape is wrapped around the cape holder.

* * * * *